US008870346B2

(12) United States Patent
Kimura

(10) Patent No.: US 8,870,346 B2
(45) Date of Patent: Oct. 28, 2014

(54) LIQUID EJECTION HEAD AND IMAGE FORMING APPARATUS INCLUDING SAME

(71) Applicant: Yuu Kimura, Kanagawa (JP)

(72) Inventor: Yuu Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/020,038

(22) Filed: Sep. 6, 2013

(65) Prior Publication Data

US 2014/0071203 A1 Mar. 13, 2014

(30) Foreign Application Priority Data

Sep. 13, 2012 (JP) ..... 2012-201327

(51) Int. Cl.
*B41J 2/14* (2006.01)
*B41J 2/16* (2006.01)

(52) U.S. Cl.
CPC ..... *B41J 2/1433* (2013.01); *B41J 2/14274* (2013.01); *B41J 2/1606* (2013.01); *B41J 2/1612* (2013.01); *B41J 2/1603* (2013.01)
USPC ..... 347/47

(58) Field of Classification Search
None
See application file for complete search history.

(56) References Cited

U.S. PATENT DOCUMENTS

| | | | | |
|---|---|---|---|---|
| 7,513,602 | B2 * | 4/2009 | Nishijima | 347/47 |
| 7,568,785 | B2 * | 8/2009 | Deguchi et al. | 347/48 |
| 8,113,633 | B2 * | 2/2012 | Hirasawa et al. | 347/71 |
| 8,262,199 | B2 * | 9/2012 | Takahashi | 347/45 |
| 2013/0147887 | A1 | 6/2013 | Kimura et al. | |

FOREIGN PATENT DOCUMENTS

| | | |
|---|---|---|
| JP | 2002-219808 | 8/2002 |
| JP | 2004-136653 | 5/2004 |
| JP | 2004-136655 | 5/2004 |
| JP | 2004-181893 | 7/2004 |
| JP | 2005-053064 | 3/2005 |
| JP | 2005-161679 | 6/2005 |
| JP | 2006-341451 | 12/2006 |
| JP | 2007-105942 | 4/2007 |
| JP | 2008-087284 | 4/2008 |
| JP | 2008-194903 | 8/2008 |
| JP | 2008-254201 | 10/2008 |
| JP | 2009-220471 | 10/2009 |
| WO | WO2006/070557 A1 | 7/2006 |

* cited by examiner

*Primary Examiner* — Lamson Nguyen
(74) *Attorney, Agent, or Firm* — Cooper & Dunham LLP

(57) ABSTRACT

A liquid ejection head includes a nozzle plate having a plurality of nozzles formed therein from which droplets are ejectable. The nozzle plate includes a nozzle substrate in which a plurality of nozzle holes each constituting a nozzle is formed, and a liquid-repellent film formed on a surface of the nozzle substrate on a droplet ejection side of the nozzle plate and on an inner wall of the nozzle on at least the droplet ejection side of the nozzle plate. A number of liquid-repellent groups per unit area in the liquid-repellent film formed on the inner wall of the nozzle decreases continuously from the droplet ejection side of the nozzle plate to a side opposite the droplet ejection side of the nozzle plate.

4 Claims, 12 Drawing Sheets

LIQUID EJECTION HEAD AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2012-201327, filed on Sep. 13, 2012, in the Japan Patent Office, the entire disclosure of which is hereby incorporated by reference herein.

BACKGROUND

1. Technical Field

Exemplary aspects of the present invention generally relate to a liquid ejection head and an image forming apparatus including the liquid ejection head.

2. Related Art

Like a printer, copier, plotter, facsimile machine, or multi-function device having two or more of these capabilities, an inkjet recording device employing a liquid ejection recording method is also a type of image forming apparatus.

Typically, the inkjet recording device includes a recording head constricted of a liquid ejection head that ejects droplets of a recording liquid such as ink onto a sheet of a recording medium to form art image on the sheet.

The liquid ejection head has a nozzle face in which multiple nozzles, from which droplets are ejected, are formed. Ejection characteristics of the liquid ejection head, such as the volume and speed with which droplets are ejected from the nozzles, vary considerably depending on the shape and quality of each nozzle. It is also known that surface characteristics of a nozzle substrate, in which nozzle holes each forming the nozzle are formed, also considerably affect the ejection characteristics of the liquid ejection head. For example, adhesion of ink or the like to the area around the nozzle on a surface of the nozzle substrate may distort the trajectory of the droplets ejected from the nozzle.

To solve these problems, a liquid-repellent film is often formed on the surface of the nozzle substrate on a side from which droplets are ejected (hereinafter referred to as a droplet ejection side). As a result, the droplet ejection side of the nozzle substrate has a uniform surface across the surface of the nozzle substrate, thereby stabilizing the ejection characteristics of the liquid ejection head.

There is known a liquid ejection head in which a liquid-repellent film is formed across a surface of a nozzle plate up to an inner wall of each nozzle.

However, provision of the liquid-repellent film to the inner wall of the nozzle drastically affects capillary action in the nozzle at the edge of the film. Consequently, pinning occurs, in which the meniscus of the liquid in the nozzle is trapped at the edge of the liquid-repellent film, thereby distorting the trajectory of the droplets ejected from the nozzle or even blocking ejection of the droplets from the nozzle completely.

SUMMARY

In view of the foregoing, illustrative embodiments of the present invention provide a novel liquid ejection head that prevents irregular ejection of droplets from the liquid ejection head, and an image forming apparatus including the liquid ejection head.

In one illustrative embodiment, a liquid ejection head includes a nozzle plate having a plurality of nozzles formed therein from which droplets are ejectable. The nozzle plate includes a nozzle substrate in which a plurality of nozzle holes each constituting a nozzle is formed, and a liquid-repellent film formed on a surface of the nozzle substrate on a droplet ejection side of the nozzle plate and on an inner wall of the nozzle on at least the droplet ejection side of the nozzle plate. A number of liquid-repellent groups per unit area in the liquid-repellent film formed on the inner wall of the nozzle decreases continuously from the droplet ejection side of the nozzle plate to a side opposite the droplet ejection side of the nozzle plate.

In another illustrative embodiment, an image forming apparatus includes the liquid ejection head described above.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
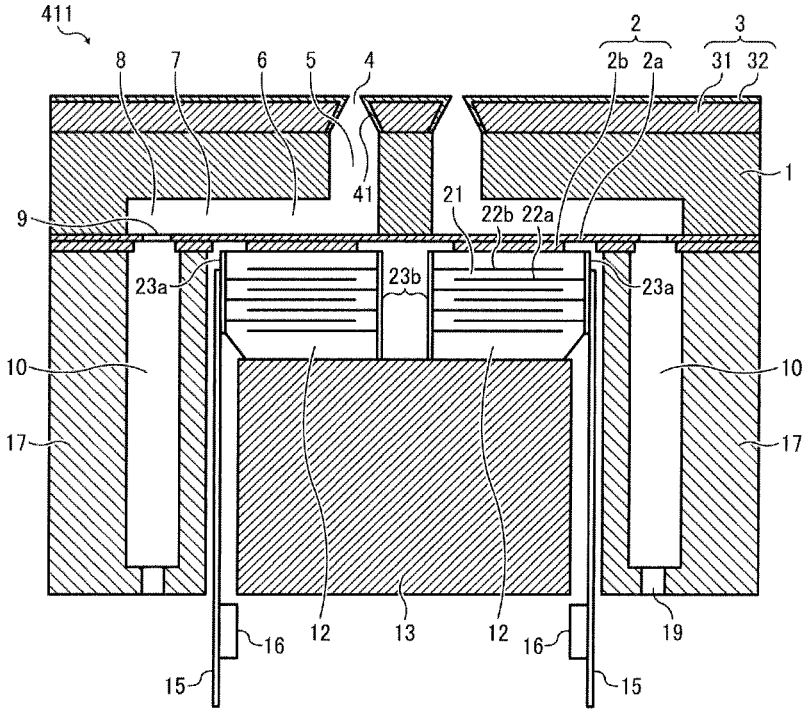
FIG. 1 is a vertical cross-sectional view illustrating an example of a configuration of a liquid ejection head along a direction perpendicular to a direction of nozzle arrays according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have substantially the same function, operate in a similar manner, and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

It is to be rioted that a "sheet" of recording media is not limited to a sheet of paper but also includes any material onto which droplets including ink droplets adhere, such as an OHP sheet, cloth, glass, and a substrate.

Image forming apparatuses hereinafter described form an image on a recording medium, such as paper, string, fiber, cloth, lather, metal, plastics, glass, wood, and ceramics by ejecting droplets onto the recording medium. In this specification, an image refers to both signifying images such as characters and figures, as well as a non-signifying image such as patterns.

In addition, ink includes any material which is a liquid when ejected from the image funning apparatuses to form images on the recording medium, such as a DNA sample, a resist material, a pattern material, and resin.

Further, an image formed on the recording medium is not limited to a flat image, but also includes an image formed on a three-dimensional object, a three-dimensional image, and so forth.

Figure 2:
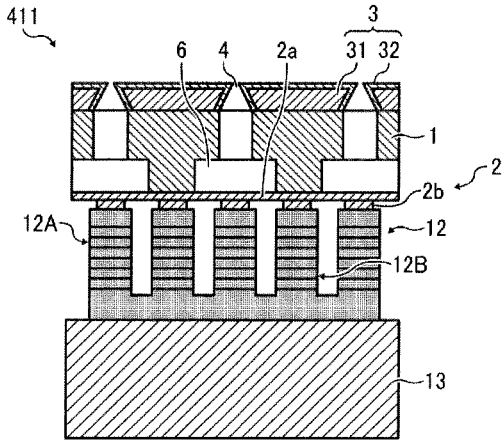
FIG. 2 is a vertical cross-sectional view of the liquid ejection head along the direction of nozzle arrays.

A description is now given of an example of a configuration of a liquid ejection head 411 according to illustrative embodiments, with reference to FIGS. 1 and 2.

FIG. 1 is a vertical cross-sectional view illustrating an example of a configuration of the liquid ejection head 411 along a direction perpendicular to a direction of nozzle arrays (or a longitudinal direction of a liquid chamber 6). FIG. 2 is a vertical cross-sectional view of the liquid ejection head 411 along the direction of nozzle arrays (or a lateral direction of the liquid chamber 6).

The liquid ejection head 411 includes a channel plate (or liquid chamber substrate) 1, a vibration plate 2 bonded to a lower face of the channel plate 1, and a nozzle plate 3 bonded to an upper face of the channel plate 1.

The channel plate 1, the vibration plate 2, and the nozzle plate 3 together form multiple liquid chambers 6 communicating with, via channels 5, respective nozzles 4 formed in the nozzle plate 3 to eject droplets therefrom, fluid resistors 7 that also function as supply channels to supply liquid to the liquid chambers 6, and communication parts 8 that communicate with the respective liquid chambers 6 via the fluid resistors 7. Liquid is supplied from a common liquid chamber 10 formed in a frame member 17, which is described in detail later, to the communication parts 8 via supply openings 9 formed in the vibration plate 2.

The channel plate 1 is formed of a silicon substrate. The silicon substrate is etched to form grooves that constitute the channels 5, the liquid chambers 6, the fluid resistors 7, and so forth. It is to be noted that, alternatively, the channel plate 1 may be formed by etching an SUS substrate using an acid etchant, or may be formed by machining such as press-punching.

The vibration plate 2 has vibrating portions (diaphragms) 2*a* corresponding to the respective liquid chambers 6 to form a part of the walls of the liquid chambers 6. Each of the vibrating portions 2*a* has a protrusion 2*b* on an outer surface thereof opposite to the liquid chamber 6. A drive element that deforms the vibrating portions 2*a* to generate energy to eject droplets from the nozzles 4, which, in the present illustrative embodiment, is a multi-layered piezoelectric member 12, has columnar piezoelectric elements 12A and 12B (hereinafter also referred to as piezoelectric columns 12A and 12B), and an upper surface of each of the piezoelectric columns 12A and 12B is bonded to the respective protrusions 2*b*. A lower surface of the piezoelectric member 12 is bonded to a base member 13.

The piezoelectric member 12 is constructed of piezoelectric layers 21 formed of lead zirconate titanate (PZT) or the like, and internal electrodes 22*a* and 22*b*, all of which are laminated alternately. Each of the internal electrodes 22*a* and 22*b* is drawn out to end faces of the piezoelectric member 12 to be connected to external electrodes 23*a* and 23*b* provided to the respective end faces. A voltage is applied to each of the external electrodes 23*a* and 23*h* to displace the piezoelectric member 12 in a direction of lamination. Grooves are formed in the piezoelectric member 12 by half-cut dicing so that the piezoelectric member 12 has a predetermined number of piezoelectric columns 12A and 12B positioned at predetermined intervals.

The piezoelectric columns 12A and 12B have the same basic configuration. A drive waveform is applied to the piezoelectric columns 12A (hereinafter also referred to as drive columns 12A) to drive the drive columns 12A, and no drive waveform is applied to the piezoelectric columns 12B (hereinafter also referred to as non-drive columns 12B) so that the non-drive columns 12B are used merely as columns. Either a bi-pitch configuration in which the drive columns 12A and the non-drive columns 12B are alternately used as illustrated in FIG. 2 or a normal-pitch configuration in which all the piezoelectric columns are used as the drive columns 12A is applicable to the present illustrative embodiment.

Two arrays of drive elements, each constructed of the multiple drive columns 12A, are formed on the base member 13.

Although the piezoelectric member 12 operates in the d33 mode to pressurize liquid within the liquid chambers 6 in the present illustrative embodiment, alternatively, the piezoelectric member 12 may operate in the d31 mode to pressurize the liquid within the liquid chambers 6.

A flexible printed circuit (FPC) 15 for transmitting a drive signal is directly connected to the external electrodes 23*a* of the drive columns 12A. The FPC 15 implements a drive circuit 16 that selectively applies a drive waveform to the drive columns 12A. It is to be noted that the external electrodes 23*b* of all the drive columns 12A, which are commonly and electrically connected to one another, are connected to a common wire of the FPC 15.

The nozzle plate 3 is constructed of a nozzle substrate 31 and a liquid-repellent film 32 provided to a surface of the nozzle substrate 31 on a side from which droplets are ejected (hereinafter referred to as a droplet ejection side). Nozzle holes 41, each forming the nozzle 4 having a diameter of from 10 μm to 35 μm, are formed in the nozzle substrate 31 at positions corresponding to the respective liquid chambers 6.

The frame member 17 formed by injection molding using, for example, epoxy resin or polyphenylene sulfide, is bonded to outer walls of a piezoelectric actuator unit constructed of the piezoelectric member 12, to which the FPC 15 is connected, and the base member 13. The common liquid chamber 10 and supply openings 19, from which the liquid is supplied to the common liquid chamber 10, are formed in the frame member 17. The supply openings 19 are connected to a supply source such as a sub-tank or an ink cartridge, not shown.

In the liquid ejection head 411 having the above-described configuration, a voltage applied to the drive columns 12A is reduced from a reference level to contract the drive columns 12A so that the vibrating portions 2*a* of the vibration plate 2 are lowered to expand the volume of each of the liquid chambers 6, thereby forcing the liquid into the liquid chambers 6. Thereafter, the voltage applied to the drive columns 12A is increased to extend the drive columns 12A in the direction of lamination so that the vibrating portions 2*a* of the vibration plate 2 are deformed toward the nozzles 4 to contract the volume of each of the liquid chambers 6. As a result, pressure is applied to the liquid within the liquid chambers 6 so that droplets are ejected from the nozzles 4.

Then, the voltage applied to the drive columns 12A is returned to the reference level to restore the vibrating portions 2*a* of the vibration plate 2 to their initial positions so that the liquid chambers 6 are expanded, thereby generating negative pressure. As a result, the liquid flows from the common liquid chamber 10 to the liquid chambers 6 via the supply openings 9, so that the liquid chambers 6 are filled with the liquid. After vibration of a meniscus formed in each of the nozzles 4 is damped, the next series of ejection is started.

It is to be noted that the method for driving the liquid ejection head 411 is not limited to the above-described example, and may be varied depending on the exact manner in which the driving waveform is applied.

Figure 3:
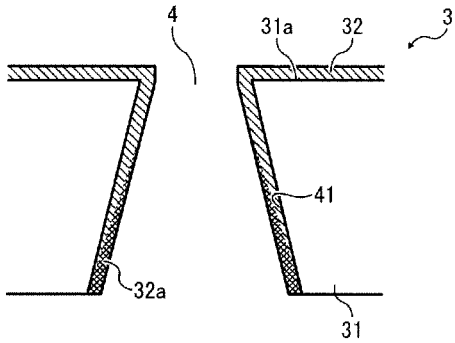
FIG. 3 is an enlarged vertical cross-sectional view illustrating a nozzle formed in a nozzle plate according to a first illustrative embodiment.

A description is now given of a first illustrative embodiment, with initial reference to FIG. 3.

FIG. 3 is an enlarged vertical cross-sectional view illustrating the nozzle 4 formed in the nozzle plate 3 according to the first illustrative embodiment.

As described above, the nozzle plate 3 includes the nozzle substrate 3, in which the nozzle holes 41, each constituting the nozzle 4, are formed. The liquid-repellent film 32 is formed on a surface 31*a* of the nozzle substrate 31 on the droplet ejection side and on an inner wall of the nozzle 4. In the present specification, the portion of the liquid-repellent film 32 that is formed on the inner wall of the nozzle 4 according to illustrative embodiments is hereinafter referred to as a liquid-repellent film 32*a*.

It is to be noted that, optionally, a base film formed of $SiO_2$ or the like that improves adhesion between the nozzle substrate 31 and the liquid-repellent film 32 may be formed between the nozzle substrate 31 and the liquid-repellent film 32.

Figure 4:
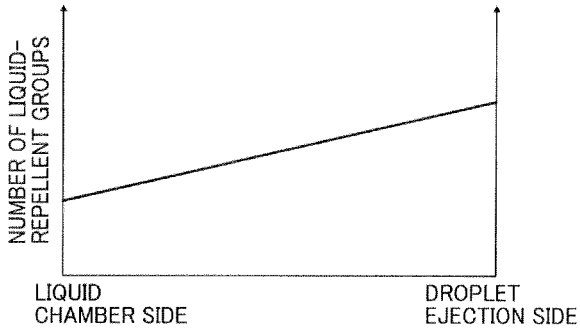
FIG. 4 is a graph showing a change in the number of liquid-repellent groups in a liquid-repellent film formed on an inner wall of the nozzle according to the first illustrative embodiment.

FIG. 4 is a graph showing a change in the number of liquid-repellent groups in the liquid-repellent film 32*a* formed on the inner wall of the nozzle 4.

As shown in FIG. 4, the number of liquid-repellent groups per unit area in the liquid-repellent film 32*a* decreases continuously from the droplet ejection side of the nozzle 4 to a liquid chamber side opposite the droplet ejection side. In other words, the number of hydrophilic groups per unit area in the liquid-repellent film 32*a* formed on the inner wall of the nozzle 4 increases continuously from the droplet ejection side to the liquid chamber side.

Figure 5:
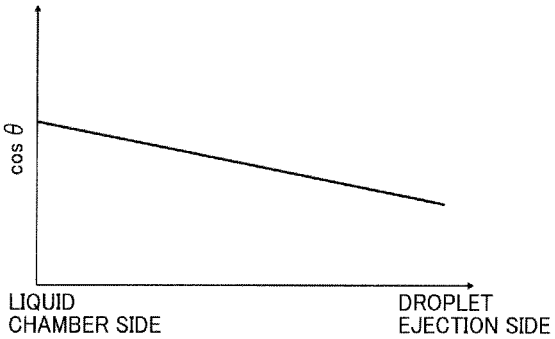
FIG. 5 is a graph showing a change in a cosine of a contact angle θ of a liquid on the liquid-repellent film formed on the inner wall of the nozzle according to the first illustrative embodiment.

As a result, a static contact angle θ of the liquid on the liquid-repellent film 32*a* decreases continuously from the droplet ejection side to the liquid chamber side, and a cosine of the contact angle θ (cos θ) increases continuously from the droplet ejection side to the liquid chamber side as illustrated in FIG. 5.

Figure 6:
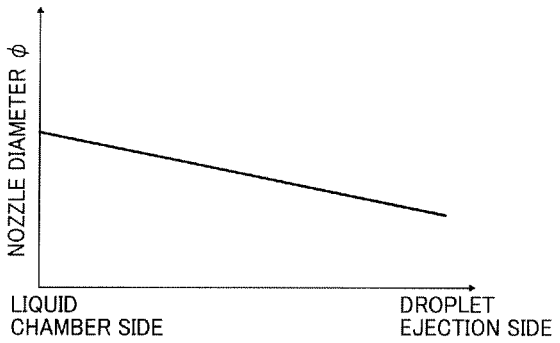
FIG. 6 is a graph showing a change in a diameter ϕ of the nozzle according to the first illustrative embodiment.

At the same time, the nozzle 4 is tapered in cross-section along the direction of ejection of droplets, such that a diameter ϕ of the nozzle 4 decreases continuously from the liquid chamber side to the droplet ejection side as illustrated in FIG. 6.

Figure 7:
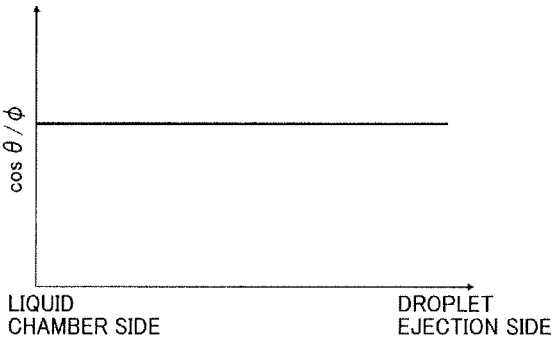
FIG. 7 is a graph showing a change in cos θ/ϕ, which corresponds to the strength of the capillary action in the nozzle, according to the first illustrative embodiment.

The strength of the capillary action in the nozzle 4 is inversely proportional to the diameter ϕ of the nozzle 4. In other words, the strength of the capillary action in the nozzle 4 is proportional to the cosine of the contact angle θ (cos θ). Therefore, in the present illustrative embodiment, cos θ/ϕ is substantially constant from the droplet ejection side of the nozzle 4 to the liquid chamber side as shown in FIG. 7. In other words, the capillary action in the nozzle 4 is continuously changed from the liquid chamber side to the droplet ejection side without an inflection point.

Figure 8:
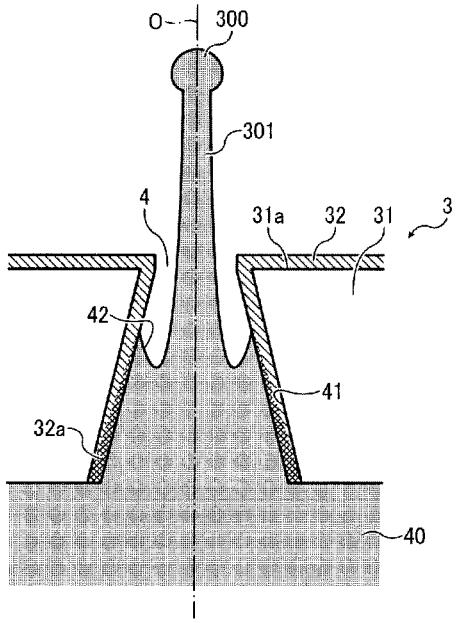
FIG. 8 is a vertical cross-sectional view illustrating a meniscus of a liquid formed in the nozzle upon ejection of a droplet according to the first illustrative embodiment.

Such a reduction in the change of the capillary action in the nozzle 4 forms a meniscus 42 symmetrical about the center O of the nozzle 4 in the direction of ejection of droplets as illustrated in FIG. 8 when a liquid 40 in the liquid chamber 6 is pressurized to eject a droplet 300 from the nozzle 4.

Accordingly, a tail 301, franc which die droplet 300 is not yet separated, is positioned at the center O of the nozzle 4. As a result, the droplet 300 is properly ejected from the nozzle 4 without distortion of the trajectory of the droplet.

For a fuller appreciation of the non-predictable effects achieved by the first illustrative embodiment, a description is now given of comparative examples.

Figure 9:
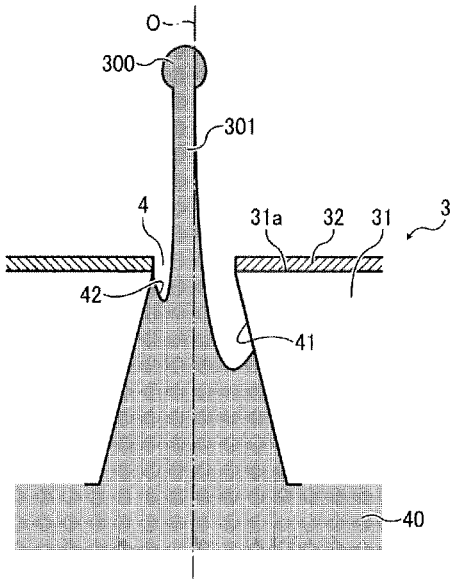
FIG. 9 is a vertical cross-sectional view illustrating a nozzle formed in a nozzle plate according to a first comparative example.

FIG. 9 is a vertical cross-sectional view illustrating the nozzle 4 formed in the nozzle plate 3 according to a first comparative example.

In the first comparative example, the liquid-repellent film 32 is formed only on the surface 31*a* of the nozzle substrate 31 on the droplet ejection side and is not formed on the inner wall of the nozzle 4.

As a result, both the diameter ϕ of the nozzle 4 and the contact angle θ of the liquid on the inner wall of the nozzle 4 are changed sharply at the edge or the nozzle 4. In other words, advance of the meniscus 42 in the nozzle 4 is stopped at that position. Consequently, when vibrating for ejecting the droplet 300 from the nozzle 4, an edge of the meniscus 42 is partially trapped, which is known as pinning of the meniscus. The pinning of the meniscus 42 is caused by the sharp change in the capillary action in the nozzle 4, and as described previously, the strength of the capillary action in the nozzle 4 is inversely proportional to the diameter ϕ of the nozzle 4 and is proportional to the cosine of the contact angle θ (cos θ).

When the pinning of the meniscus 42 occurs, the tail 301, from which the droplet 300 is not yet separated, is attracted to a side on which the meniscus 42 is pinned, and is offset from the center O of the nozzle 4 as illustrated in FIG. 9. Consequently, the droplet 300 is formed asymmetrically about the center O of the nozzle 4. As a result, the trajectory of the droplet 300 from the nozzle 4 is distorted, causing stripes and uneven image density in resultant images.

Figure 10:
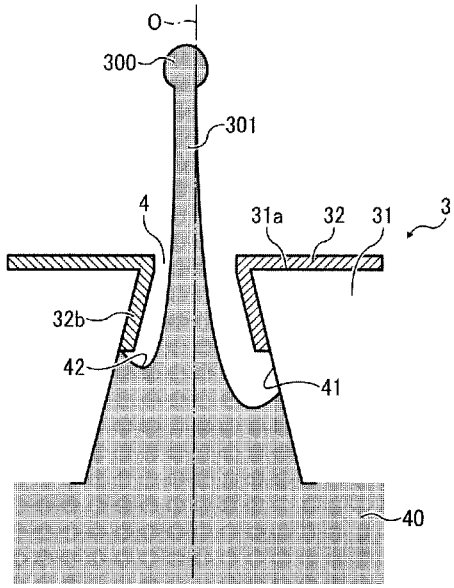
FIG. 10 is a vertical cross-sectional view illustrating a nozzle formed in a nozzle plate according to a second comparative example.

A description is now given of a second comparative example with reference to FIG. 10.

FIG. 10 is a vertical cross-sectional view illustrating the nozzle 4 formed in the nozzle plate 3 according to the second comparative example.

In the second comparative example, the liquid-repellent film 32 is formed across the surface 31*a* of the nozzle substrate 31 on the droplet ejection side to a middle of the inner wall of the nozzle 4. The portion of the liquid-repellent film 32 that is formed on the inner wall of the nozzle 4 in the second comparative example is hereinafter referred to as a liquid-repellent film 32*b*.

Figure 11:
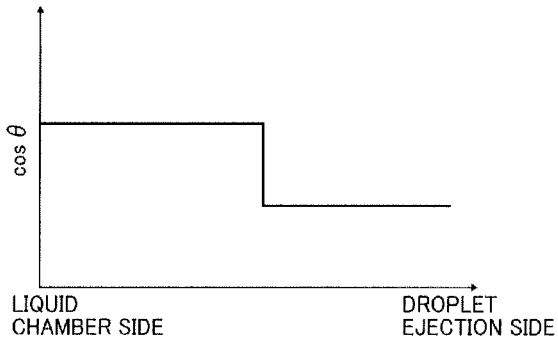
FIG. 11 is a graph showing a change in a cosine of a contact angle θ of a liquid on a liquid-repellent film formed on an inner wall of the nozzle according to the second comparative example.
Figure 12:
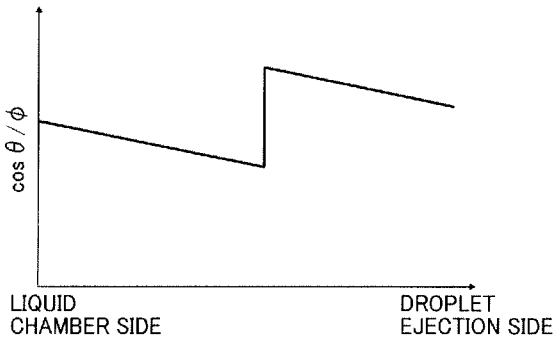
FIG. 12 is a graph showing a change in cos θ/ϕ according to the second comparative example.

As illustrated in FIG. 11, the cosine of the contact angle θ (cos θ) in the nozzle 4 is constant either at a portion with the liquid repellent film 32*b* or a portion without the liquid-repellant film 32*b*. As a result, cos θ/ϕ is changed sharply at an inner edge of the liquid-repellent film 32*b* in the nozzle 4 as shown in FIG. 12. Consequently, the meniscus 42 formed in the nozzle 4 tends to remain at the inner edge of the liquid-repellent film 32*b*.

Thus, also in the second comparative example, advance of the meniscus 42 is stopped at a certain position within the nozzle 4. Consequently, when vibrating for ejecting the droplet 300 from the nozzle 4, the edge of the meniscus 42 is partially trapped. As a result, the droplet 300 is formed asymmetrical about the center O of the nozzle 4 so that the trajectory of the droplet 300 from the nozzle 4 is distorted, causing stripes and uneven image density in resultant images.

Figure 13:
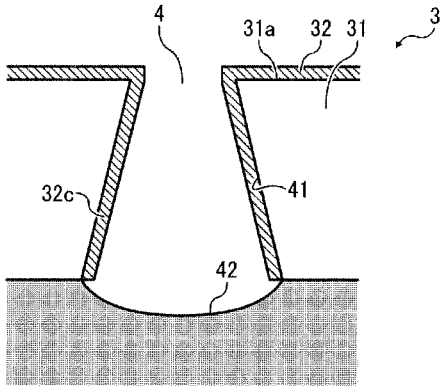
FIG. 13 is a vertical cross-sectional view illustrating a nozzle formed in a nozzle plate according to a third comparative example.

A description is now given of a third comparative example, with reference to FIG. 13.

FIG. 13 is a vertical cross-sectional view illustrating the nozzle 4 formed in the nozzle plate 3 according to the third comparative example.

In a manner similar to the first illustrative embodiment, the liquid-repellent film 32 is formed across the inner wall of the nozzle 4 in the third comparative example. The portion of the liquid-repellent film 32 that is formed on the inner wall of the nozzle 4 in the third comparative example is hereinafter referred to as a liquid-repellent film 32*c*. However, differing from the first illustrative embodiment, the number of hydrophilic groups in the liquid-repellent film 32*c* is constant across the inner wall of the nozzle 4 in the third comparative example.

Consequently, the meniscus 42 formed in the nozzle 4 is partially pinned at the entrance of nozzle 4 as shown in FIG. 13. As a result, the nozzle 4 is not filled with the liquid 40, blocking ejection of droplets from the nozzle 4.

By contrast, in the first illustrative embodiment, the number of liquid-repellent groups in the liquid-repellent film 32*a* formed on the inner wall of the nozzle 4 decreases from the droplet ejection side to the liquid chamber side. Accordingly, the capillary action in the nozzle 4 is not sharply changed from the liquid chamber side to the droplet ejection side. As a result, the meniscus 42 formed in the nozzle 4 is not partially trapped, so that the droplets are properly ejected from the nozzle 4 in the direction of ejection of droplets.

Figure 14:
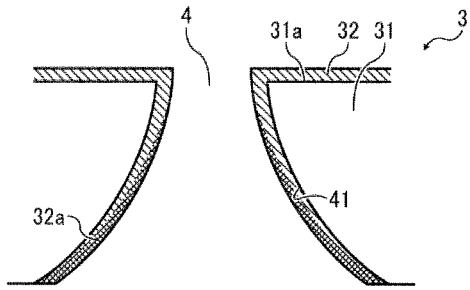
FIG. 14 is an enlarged vertical cross-sectional view illustrating a nozzle formed in a nozzle plate according to a second illustrative embodiment.

A description is now given of a second illustrative embodiment, with reference to FIG. 14.

FIG. 14 is an enlarged vertical cross-sectional view illustrating the nozzle 4 formed in the nozzle plate 3 according to the second illustrative embodiment.

In the second illustrative embodiment, the inner wall of the nozzle 4 is curved in cross-section along the direction of ejection of droplets as shown in FIG. 14, and the diameter ϕ of the nozzle 4 increases from the droplet ejection side to the liquid chamber side. The nozzle plate 3 having the nozzle 4 according to the second illustrative embodiment may be formed by, for example, electrocasting.

In a manner similar to the first illustrative embodiment, the liquid-repellent film 32*a* is formed on the inner wall of the nozzle 4 in the second illustrative embodiment, and the number of liquid-repellent groups per unit area in the liquid-repellent film 32*a* decreases continuously from the droplet ejection side to the liquid chamber side.

Figure 15:
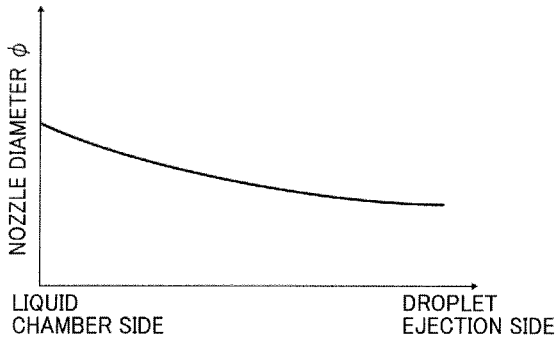
FIG. 15 is a graph showing a change in a diameter ϕ of the nozzle according to the second illustrative embodiment.
Figure 16:
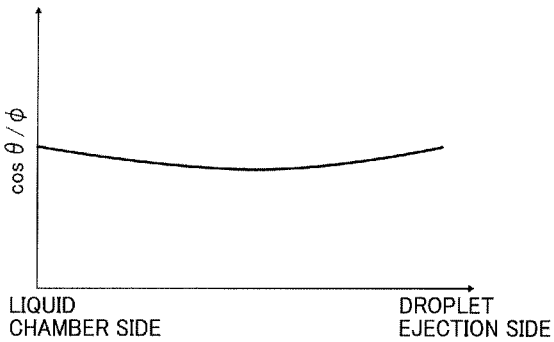
FIG. 16 is a graph showing a change in cos θ/ϕ according to the second illustrative embodiment.

Thus, the diameter ϕ of the nozzle 4 decreases from the liquid chamber side to the droplet ejection side along a curve as shown in FIG. 15, and cos θ/ϕ remains approximately constant along a curve, without an inflection point, as shown in FIG. 16.

As a result, the second illustrative embodiment achieves the same effects as those achieved by the first illustrative embodiment described previously.

Figure 17:
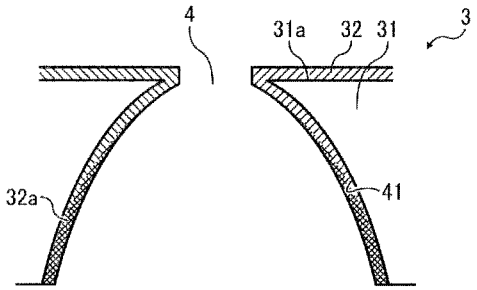
FIG. 17 is an enlarged vertical cross-sectional view illustrating a nozzle formed in a nozzle plate according to a third illustrative embodiment.

A description is now given of a third illustrative embodiment, with reference to FIG. 17.

FIG. 17 is an enlarged vertical cross-sectional view illustrating the nozzle 4 formed in the nozzle plate 3 according to the third illustrative embodiment.

In the third illustrative embodiment, the inner wall of the nozzle 4 is curved such that the nozzle 4 has an inverted U-shape in cross-section along the direction of ejection of droplets as shown in FIG. 17, and the diameter ϕ of the nozzle 4 increases from the droplet ejection side to the liquid chamber side. The nozzle plate 3 having the nozzle 4 according to the third illustrative embodiment may be formed by, for example, etching.

In a manner similar to the first illustrative embodiment, the liquid-repellent film 32*a* is formed on the inner wall of the nozzle 4 in the third illustrative embodiment, and the number of liquid-repellent groups per unit area in the liquid-repellent film 32*a* decreases continuously from the droplet ejection side to the liquid chamber side.

Figure 18:
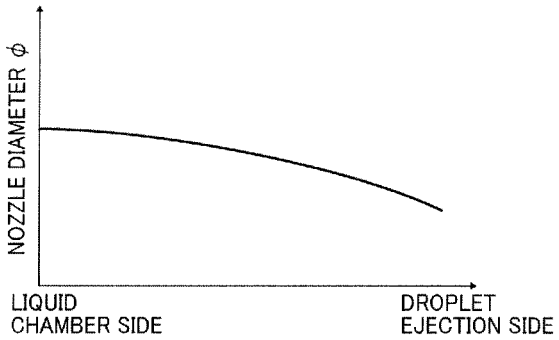
FIG. 18 is a graph showing a change in a diameter ϕ of the nozzle according to the third illustrative embodiment.
Figure 19:
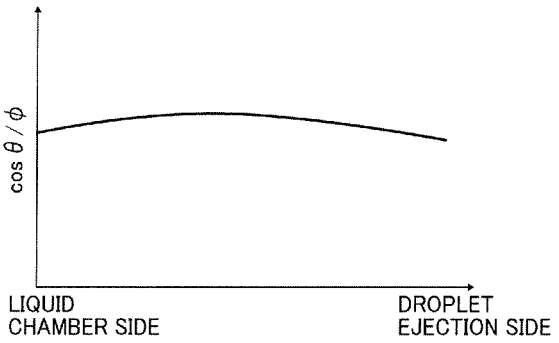
FIG. 19 is a graph showing a change in cos θ/ϕ according to the third illustrative embodiment.

Thus, in the third illustrative embodiment, the diameter ϕ of the nozzle 4 decreases from the liquid chamber side to the droplet ejection side along a curve as shown in FIG. 18, and cos θ/ϕ remains approximately constant along a curve, without an inflection point, as shown in FIG. 19. As a result, the third illustrative embodiment achieves the same effects as those achieved by the first illustrative embodiment described previously.

Figure 20A:
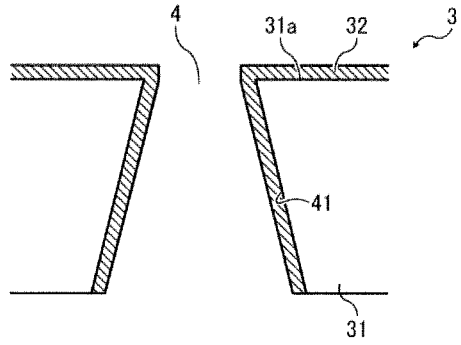
FIGS. 20A to 20C are schematic vertical cross-sectional views respectively illustrating steps in a process of manufacturing the nozzle plate according to the first illustrative embodiment.
Figure 20B:
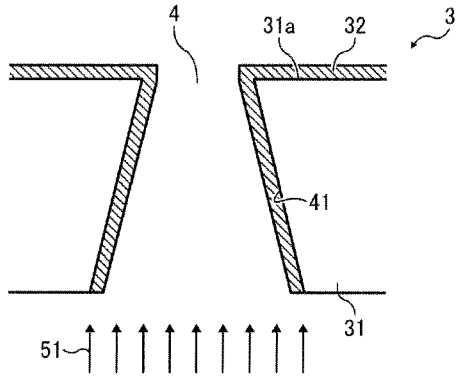
Figure 20C:
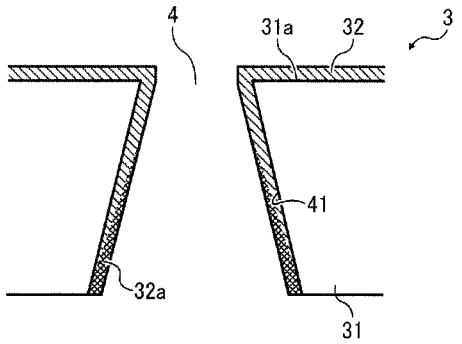

A description is now given of an example of a method for manufacturing the nozzle plate 3 according to the first illustrative embodiment, with reference to FIGS. 20A to 20C. FIGS. 20A to 20C are schematic views illustrating steps in a process of manufacturing the nozzle plate 3 according to the first illustrative embodiment, respectively.

It is to be noted that the method for manufacturing the liquid-repellent film 32 of the nozzle plate 3 described below is also applicable to manufacture of the liquid-repellent film 32 of the nozzle plate 3 according to the second and third illustrative embodiments described above as well as subsequent illustrative embodiments described later.

First, the liquid-repellent film 32 is formed on both the surface 31*a* of the nozzle substrate 31 on the droplet ejection side and the inner wall of the nozzle 4 as illustrated in FIG. 20A.

Next, as illustrated in FIG. 20B, irradiation 51 with energy such as plasma is carried out from the liquid chamber side of the nozzle 4 to preferentially etch the liquid-repellent film 32 at a portion closer to the liquid chamber 6. As a result, the liquid-repellent groups are removed from the portion in the liquid-repellent film 32 closer to the liquid chamber 6.

It is to be noted that, to achieve the gradient in the number of liquid-repellent groups within the liquid-repellent film 32*a* formed on the inner wall of the nozzle 4 according to the illustrative embodiments described above, a type of gas for generating plasma, a degree of vacuum during irradiation, an amount of energy such as a voltage or an electric current, a processing time, and so forth are controlled based on materials used for the liquid-repellent film 32, a degree of polymerization of the liquid-repellent film 32, and so forth. Too much irradiation 51 with plasma removes almost all the liquid-repellent groups from the liquid-repellent film 32. However, too little irradiation 51 with plasma hardly removes any of the liquid-repellent groups from the liquid-repellent film 32.

As a result, the nozzle plate 3 having the nozzle 4 provided with the liquid-repellent film 32*a* on the inner wall thereof, in which the number of liquid-repellent groups per unit area decreases continuously from the droplet ejection side to the liquid chamber side, is provided as illustrated in FIG. 20C.

It is known that the contact angle θ of the liquid on the liquid-repellent film 32 generally varies depending on the number of liquid-repellent groups in the molecules that constitute the liquid-repellent film 32.

For example, in a case in which the liquid-repellent film 32 is formed of pertluoropolyether (PFPE), the trifluoromethyl (CF3) groups have higher liquid repellency than other functional groups included in the liquid-repellent film 32. Thus, the number of trifluoromethyl groups is continuously reduced further compared to the number of other functional groups included in the liquid-repellent film 32 such that the contact angle θ of the liquid on the liquid-repellent film 32*a* decreases continuously.

As described above, one of the methods for providing the liquid-repellent film 32*a* to the inner wall of the nozzle 4 is by the irradiation 51 from the liquid chamber side after the formation of the liquid-repellent film 32 on both sides of the nozzle substrate 31 and the inner wall of the nozzle 4.

The liquid-repellent film 32 formed on the inner wall of the nozzle 4 at the portion closer to the liquid chamber 6 is preferentially etched by the irradiation 51. As a result, the number of liquid-repellent groups in the liquid-repellent film 32 is reduced to form the liquid-repellent film 32*a* on the inner wall of the nozzle 4, so that the contact angle θ of the liquid on the liquid-repellent film 32*a* decreases continuously from the droplet ejection side to the liquid chamber side.

An example of an effective method for evaluating the number of liquid-repellent groups includes time-of-flight secondary ion mass spectrometry. The greater the number of liquid-repellent group-derived secondary ions in the secondary ions thus detected, the higher the proportion of the liquid-repellent groups and the larger the contact angle θ. It is ideal that the number of liquid-repellent groups per unit area in the liquid-repellent film 32*a* continuously increase from the liquid chamber side to the droplet ejection side as shown in FIG. 4.

Figure 21:
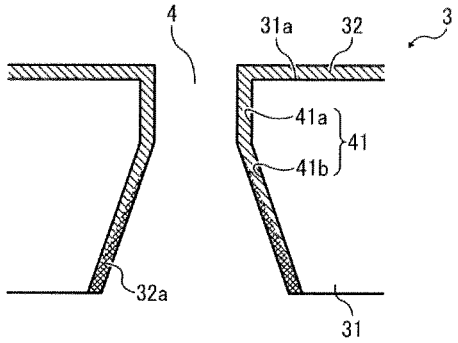
FIG. 21 is an enlarged vertical cross-sectional view illustrating a nozzle formed in a nozzle plate according to a fourth illustrative embodiment.

A description is now given of a fourth illustrative embodiment, with reference to FIG. 21.

FIG. 21 is an enlarged vertical cross-sectional view illustrating the nozzle 4 formed in the nozzle plate 3 according to the fourth illustrative embodiment.

In the fourth illustrative embodiment, the nozzle hole 41 that constitutes the nozzle 4 is constructed of a linear portion 41*a* and a tapered portion 41*b*. The linear portion 41*a* is provided to the droplet ejection side of the nozzle 4 and has a uniform diameter ϕ. A diameter ϕ of the tapered portion 41*b* increases from the end of the linear portion 41*a* to the liquid chamber side of the nozzle 4.

In a case in which the nozzle hole 41 that constitutes the nozzle 4 according to the fourth illustrative embodiment is formed in the nozzle substrate 31 by press-punching, with the puncher having a shape that corresponds to the shape of the nozzle hole 41 having the linear portion 41*a* and the tapered portion 41*b*.

Provision of the linear portion 41*a* to the nozzle 4 prevents a change in the diameter ϕ of the nozzle 4 on the droplet ejection side even in a case in which an amount of pressing of the nozzle substrate 31 by the puncher to form the nozzle hole 41 is changed.

Figure 22:
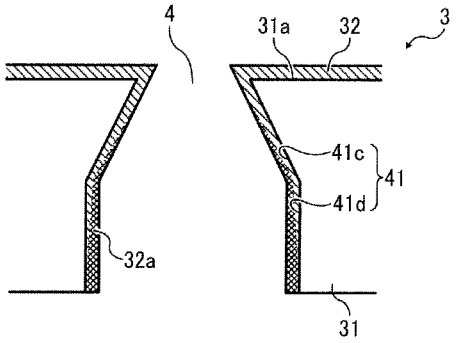
FIG. 22 is an enlarged vertical cross-sectional view illustrating a nozzle formed in a nozzle plate according to a fifth illustrative embodiment.

A description is now given of a fifth illustrative embodiment with reference to FIG. 22.

FIG. 22 is an enlarged vertical cross-sectional view illustrating the nozzle 4 formed in the nozzle plate 3 according to the fifth illustrative embodiment.

In the fifth illustrative embodiment, the nozzle hole 41 that constitutes the nozzle 4 is constructed of a tapered portion 41*c* and a linear portion 41*d*. A diameter ϕ of the tapered portion 41*c* gradually increases from the droplet ejection side of the nozzle 4 to the linear portion 41*d*. The linear portion 41*d* has a uniform diameter ϕ and extends from the end of the tapered portion 41*c* toward the liquid chamber side of the nozzle 4.

In a case in which the nozzle hole 41 that constitutes the nozzle 4 according to the fifth illustrative embodiment is formed in the nozzle substrate 31 by press-punching, a thin portion of the puncher that corresponds to the exit of the nozzle 4 on the droplet ejection side is more fragile. To prevent breakage of the puncher, a thicker portion (portion of increased diameter) is enlarged on the liquid chamber side, from which the puncher presses the nozzle substrate 31.

Figure 23:
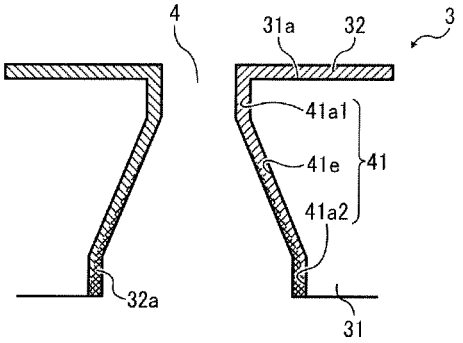
FIG. 23 is an enlarged vertical cross-sectional view illustrating a nozzle formed in a nozzle plate according to a sixth illustrative embodiment.

A description is now given of a sixth illustrative embodiment, with reference to FIG. 23.

FIG. 23 is an enlarged vertical cross-sectional view illustrating the nozzle 4 formed in the nozzle plate 3 according to the sixth illustrative embodiment.

In the sixth illustrative embodiment, the nozzle hole 41 that constitutes the nozzle hole 4 is constructed of a first linear portion 41*a*1, a tapered portion 41*e*, and a second linear portion 41*a*2. The first linear portion 41*a*1 has a uniform diameter ϕ and is provided to the droplet ejection side of the nozzle 4. A diameter ϕ of the tapered portion 41*e* gradually increases from the end of the first linear portion 41*a*1 toward the liquid chamber side of the nozzle 4. The second linear portion 41*a*2 has a uniform diameter ϕ and extends from the end of the tapered portion 41*e* toward the liquid chamber side of the nozzle 4.

Thus, the sixth illustrative embodiment achieves the same effects as those achieved by both the fourth and fifth illustrative embodiments described above.

Figure 24:
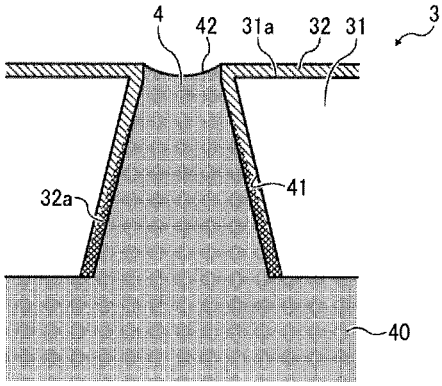
FIG. 24 is an enlarged vertical cross-sectional view illustrating a nozzle formed in a nozzle plate according to a seventh illustrative embodiment.
Figure 25:
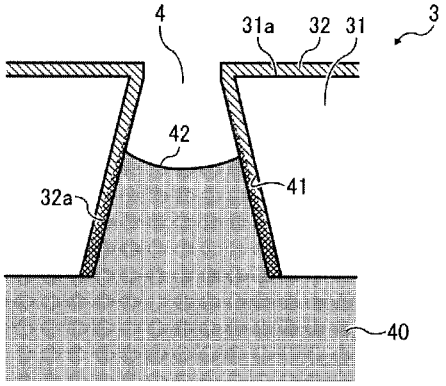
FIG. 25 is a vertical cross-sectional view illustrating the nozzle formed in the nozzle plate in a case in which the contact angle θ of the liquid on the liquid-repellent film formed on the inner wall of the nozzle is excessively large.

A description is now given of a seventh illustrative embodiment, reference to FIGS. 24 and 25.

FIG. 24 is an enlarged vertical cross-sectional view illustrating the nozzle 4 formed in the nozzle plate 3 according to the seventh illustrative embodiment. FIG. 25 is a vertical cross-sectional view of the nozzle 4 in a case in which the contact angle θ of the liquid on the liquid-repellent film 32*a* formed on the inner wall of the nozzle 4 is excessively large.

It is preferable that the meniscus 42 be formed at the edge of the nozzle 4 as illustrated in FIG. 24 when the liquid ejection head 411 is filled with the liquid 40.

However, if the contact angle θ of the liquid on the liquid-repellent film 32*a* formed on the inner wall of the nozzle 4 is excessively large, the liquid 40 is not forced to reach the edge of the nozzle 4. Consequently, the meniscus 42 is formed in the middle of the nozzle 4 as illustrated in FIG. 25.

To fill the nozzle 4 with the liquid 40 as illustrated in FIG. 24, it is preferable that an upper limit for the contact angle θ of the liquid on the liquid-repellent film 32*a* formed on the inner wall of the nozzle 4 be not greater than 80°.

Figure 26:
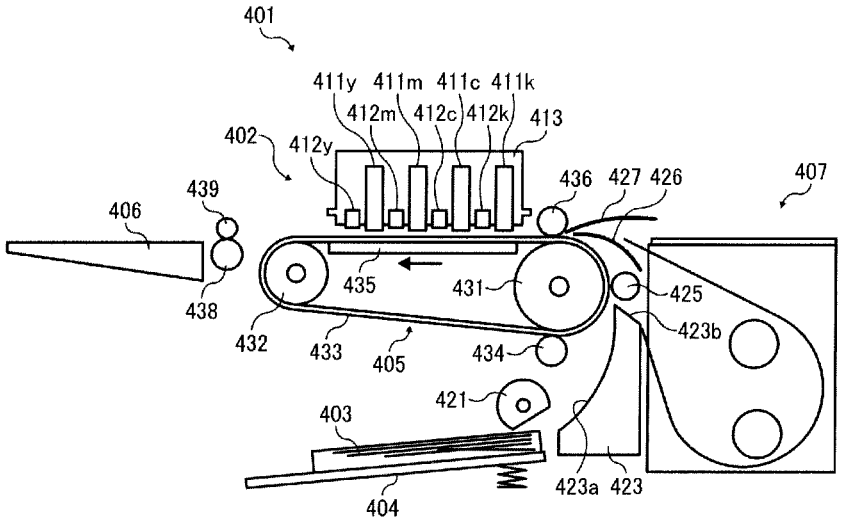
FIG. 26 is a schematic view illustrating an example of a configuration of a mechanical portion of an image forming apparatus according to illustrative embodiments.

A description is now given of an example of a configuration and operation of the image forming apparatus 401 including the liquid ejection head 411 according to illustrative embodiments, with reference to FIG. 26.

FIG. 26 is a schematic view illustrating an example of a configuration of a mechanical portion of the image forming apparatus 401.

The image forming apparatus 401 is a line-type inkjet recording device and includes an image forming part 402 and a sheet tray 404 disposed in a lower part of the image forming apparatus 401. The sheet tray 404 accommodates a stack of multiple sheets 403.

The image forming part 402 forms images on the sheets 403 fed from the sheet tray 404 while the sheets 403 are being conveyed by a conveyance mechanism 405. Thereafter, the sheets 403 having the images thereon are discharged from the image forming apparatus 401 to a discharge tray 406 provided to a lateral side of the image forming apparatus 401.

The image forming apparatus 401 further includes a duplex unit 407 detachably attachable to the image forming apparatus 401. During duplex image formation, the sheet 403 having the image on a front side thereof is conveyed backward by the conveyance mechanism 405 to the duplex unit 407. The duplex unit 407 reverses and conveys the sheet 403 to the conveyance mechanism 405 such that an image is formed on a back side of the sheet 403 by the image forming part 402. The sheet 403 having the images on both sides thereof is then discharged to the discharge tray 406.

The image forming part 402 includes recording heads 411*k*, 411*c*, 411*m*, and 411*y*, each constituted of the full-line type liquid ejection head 411 according to the foregoing illustrative embodiments (hereinafter also collectively referred to as recording heads 411). Each of the recording heads 411 ejects droplets of a specific color, that is, black (k), cyan (c), magenta (m), or yellow (y).

Each recording head 411 is attached to a head holder 413 such that the nozzle face of the recording head 411 in which nozzle arrays, each constituted of the multiple nozzles 4, are formed faces downward. It is to be noted that, examples of the full-line type liquid ejection head include a configuration in which a single liquid ejection head is used to form a single line of an image, and a configuration in which multiple liquid ejection heads are arranged in a zigzag pattern to form a single line of an image.

Maintenance/recovery mechanisms 412*k*, 412*c*, 412*m*, and 412*y* (hereinafter collectively referred to as maintenance/recovery mechanisms 412) that maintain the performance of the recording heads 411 are provided for the respective recording heads 411.

During maintenance of the recording heads 411 such as purging and wiping, each maintenance/recovery mechanism 412 and the corresponding recording head 411 are moved relative to each other, so that a capping member and so forth included in the maintenance/recovery mechanism 412 face the nozzle face of the corresponding recording head 411.

Although the recording heads 411*k*, 411*c*, 411*m*, and 411*y* are disposed, in that order, from upstream to downstream in a direction of conveyance of the sheet 403 in the example illustrated in FIG. 26, the arrangement of the recording heads 411 and the number of colors used are not limited thereto.

In addition, each recording head 411 may be formed either individually or together with a liquid cartridge, which supplies liquid to the recording head 411, as a single integrated unit.

A sheet feed roller 421 and a separation pad, not shown, separate the sheets 403 in the sheet tray 404 one by one to feed each sheet 403 between a conveyance belt 433 of the conveyance mechanism 405 and a registration roller 425 along a first guide surface 423*a* of a guide member 423. Thereafter, the sheet 403 is conveyed to the conveyance belt 433 via a guide member 426 at a predetermined timing.

The guide member 423 also has a second guide surface 423*b* that guides the sheet 403 conveyed from the duplex unit 407. The image forming apparatus 401 further includes a guide member 427 that guides the sheet 403 returned from the conveyance mechanism 405 to the duplex unit 407 during duplex image formation.

The conveyance mechanism 405 includes the endless conveyance belt 433 wound around a drive roller, that is, a conveyance roller 431, and a driven roller 432, a charging roller 434 that charges the conveyance belt 433, a platen member 435 that flattens the conveyance belt 433 at a portion opposite the image forming part 402, a pressing roller 436 that presses the sheet 403 conveyed by the conveyance belt 433 against the conveyance roller 431, and a cleaning roller including a porous body, not shown, that removes liquid such as ink from the conveyance belt 433.

A discharge roller 438 and a spur 439, each of which discharges the sheet 403 having the image thereon to the discharge tray 406, are provided downstream from the conveyance mechanism 405.

The conveyance belt 433 rotated counterclockwise in FIG. 26 is contacted and charged by the charging roller 434, to which a high voltage is applied. As a result, the sheet 403 conveyed to the conveyance belt 433 thus charged is electrostatically attracted to the conveyance belt 433. Curl and unevenness in the sheet 403, which is strongly attracted to the conveyance belt 433, are corrected to flatten the sheet 403.

The recording heads 411 eject droplets onto the sheet 403 while the sheet 403 is moved as the conveyance belt 433 rotates. As a result, an image is formed on the sheet 403. Thereafter, the sheet 403 having the image thereon is discharged to the discharge tray 406 by the discharge roller 438.

Thus, the image forming apparatus 401 including the liquid ejection heads 411 according to the foregoing illustrative embodiments can securely provide higher-quality images at higher speed.

The foregoing illustrative embodiments are applicable to either serial-type image forming apparatuses or to the Line-type image forming apparatuses.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A liquid ejection head, comprising:

a nozzle plate having a plurality of nozzles formed therein from which droplets are ejectable, comprising:

a nozzle substrate in which a plurality of nozzle holes each constituting a nozzle is formed; and a liquid-repellent film formed on a surface of the nozzle substrate on a droplet ejection side of the nozzle plate and on an inner wall of the nozzle on at least the droplet ejection side of the nozzle plate, wherein a number of liquid-repellent groups per unit area in the liquid-repellent film formed on the inner wall of the nozzle decreases continuously from the droplet ejection side of the nozzle plate to a side opposite the droplet ejection side of the nozzle plate.

2. The liquid ejection head according to claim 1, wherein the inner wall of the nozzle has a linear portion provided to the droplet ejection side of the nozzle plate and extending parallel to a direction of ejection of the droplets.

3. The liquid ejection head according to claim 1, wherein an upper limit of a static contact angle of liquid on the liquid-repellent film formed on the inner wall of the nozzle is not greater than 80°.

4. An image forming apparatus comprising a liquid ejection head, the liquid ejection head comprising:

a nozzle plate having a plurality of nozzles formed therein from which droplets are ejectable, comprising:

a nozzle substrate in which a plurality of nozzle holes each constituting a nozzle is formed; and a liquid-repellent film formed on a surface of the nozzle substrate on a droplet ejection side of the nozzle plate and on an inner wall of the nozzle on at least the droplet ejection side of the nozzle plate, wherein a number of liquid-repellent groups per unit area in the liquid-repellent film formed on the inner wall of the nozzle decreases continuously from the droplet ejection side of the nozzle plate to a side opposite the droplet ejection side of the nozzle plate.

* * * * *